US007520264B2

(12) United States Patent
Straka

(10) Patent No.: US 7,520,264 B2
(45) Date of Patent: Apr. 21, 2009

(54) IGNITION CIRCUIT

(75) Inventor: David A. Straka, Hudson, OH (US)

(73) Assignee: Delta Systems, Inc., Streetsboro, OH (US)

( * ) Notice: Subject to any disclaimer, the term of this patent is extended or adjusted under 35 U.S.C. 154(b) by 0 days.

(21) Appl. No.: 11/758,724

(22) Filed: Jun. 6, 2007

(65) Prior Publication Data

US 2008/0022971 A1 Jan. 31, 2008

Related U.S. Application Data

(60) Provisional application No. 60/834,552, filed on Jul. 31, 2006.

(51) Int. Cl.
*F02P 5/00* (2006.01)
*F02P 1/00* (2006.01)

(52) U.S. Cl. ..... 123/406.57; 123/599; 307/10.3

(58) Field of Classification Search ..... 123/406.56, 123/406.57, 406.58, 599, 600, 609, 406.66; 307/10.3, 10.6
See application file for complete search history.

(56) References Cited

U.S. PATENT DOCUMENTS 4,173,963 A * 11/1979 Heuwieser et al. ..... 123/149 D
4,336,778 A * 6/1982 Howard ..... 123/334
4,503,823 A * 3/1985 Shibukawa et al. ..... 123/406.66
4,509,493 A * 4/1985 Nash ..... 123/406.57
4,911,126 A * 3/1990 Notaras et al. ..... 123/406.54
5,190,019 A * 3/1993 Harvey ..... 123/630
5,197,430 A * 3/1993 Hoshiba et al. ..... 123/406.54
5,782,210 A * 7/1998 Venturoli et al. ..... 123/41 E
5,808,451 A * 9/1998 Endou et al. ..... 322/24
6,109,010 A * 8/2000 Heal et al. ..... 56/10.8
6,437,458 B1 * 8/2002 Baggett ..... 307/9.1
6,534,958 B1 * 3/2003 Graber et al. ..... 322/11
6,575,134 B1 * 6/2003 Bowling ..... 123/335
6,653,807 B2 * 11/2003 Saito et al. ..... 318/430
2002/0039951 A1 * 4/2002 Hasegawa ..... 477/183
2002/0043947 A1 * 4/2002 Saito et al. ..... 318/430

* cited by examiner

*Primary Examiner*—John T Kwon
(74) *Attorney, Agent, or Firm*—Calfee, Halter & Griswold LLP

(57) ABSTRACT

An ignition circuit causes a magneto to continue to provide spark to an engine for a delay period after the ignition switch is switched off. After the delay period, the ignition circuit routes energy from the magneto to actuate a magneto disable switch to provide a path to ground for the magneto.

23 Claims, 8 Drawing Sheets

IGNITION CIRCUIT

CROSS REFERENCE TO RELATED APPLICATIONS

This non-provisional application claims the benefit of U.S. Provisional Patent Application No. 60/834,552, entitled "Ignition Circuit," filed on Jul. 31, 2006, the entire disclosure of which is incorporated herein by reference, to the extent that it is not conflicting with the present application.

FIELD OF THE INVENTION

The present invention relates to circuits for controlling magneto operated engines.

BACKGROUND OF THE INVENTION

Many small engines use a magneto for ignition of fuel. Such small engines may be used in a wide variety of different applications, including lawn mowers, lawn tractors, chain saws, and other lawn, garden and outdoor tools. FIGS. 7A and 7B schematically illustrate an engine 500 with a magneto ignition system 502. The magneto ignition system 502 comprises a magneto 504, an ignition switch 506, and a fuel pump 508. Referring to FIG. 7A, when the ignition switch 506 is in a RUN state, the magneto 504 is not grounded and can provide spark to the engine 500 and the fuel pump 508 is connected to a voltage source 510. As such, the engine 500 can run when the ignition switch 506 is in the RUN state. Referring to FIG. 7B, when the ignition switch 506 is in an OFF state, the magneto 504 is grounded and spark is not provided to the engine 500 and the fuel pump 508 is disconnected from the voltage source 510. As such, the engine 500 is killed when the ignition switch 506 is in the OFF state.

SUMMARY

An ignition circuit for a magneto delays grounding of the magneto for a period of time after the ignition is shut off. Two alternate paths for the magneto's energy are provided. A first alternate path allows the magneto to continue to provide spark to the engine and a second alternate path grounds the magneto so that no spark is generated. A delay mechanism connects the magneto to the first alternate path while the ignition switch is on and for a delay period after the ignition switch is turned off. After the delay period, the delay mechanism routes energy from the magneto along the second alternate path.

According to an embodiment, an apparatus is provided that includes a portioning arrangement provides two alternate paths for magneto energy, a first path through a diverting arrangement that prevents the magneto from being grounded and a second path through a magneto disable switch that grounds the magneto. A timing arrangement controls the diverting arrangement to provide the first alternate path for a delay period after the ignition is shut off. After the delay period, the portioning arrangement directs the magneto's energy through the second alternate path. The magneto's energy is used to transition the magneto disable switch to a conducting condition to ground the magneto during subsequent magneto energy pulses.

DETAILED DESCRIPTION

Figure 7A:
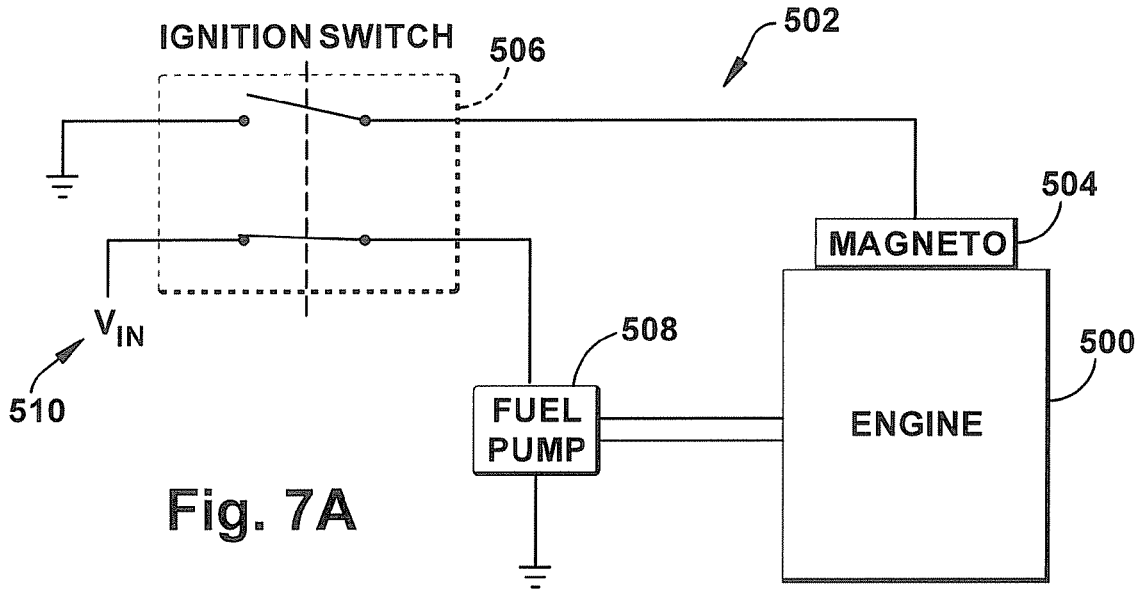
FIG. 7A is a schematic illustration of an engine with a magneto ignition system.
Figure 7B:
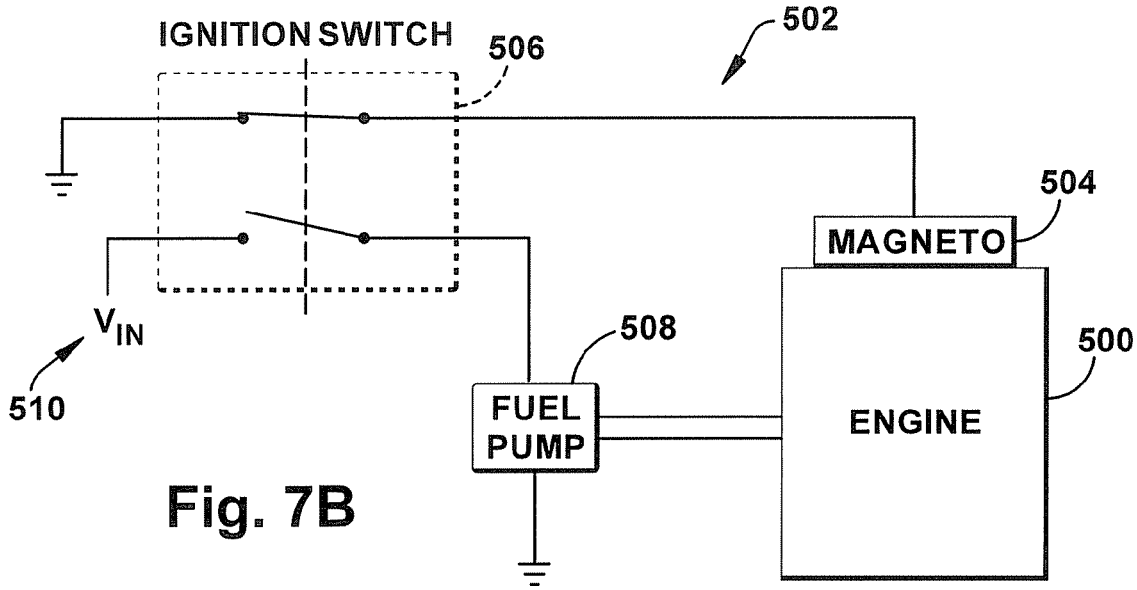
FIG. 7B is a schematic illustration of an engine with a magneto ignition system.

One characteristic of the magneto ignition system 502 illustrated by FIGS. 7A and 7B is that the power to the fuel pump 508 is cut off at the same time the magneto 504 is grounded when the switch 506 is turned to the off position. As a result, the engine 500 is killed by grounding of the magneto 504 when there is fuel remaining in a combustion chamber of the engine and/or between the fuel pump and the engine. The piston or pistons will continue to reciprocate for a short period of time while no spark is provided by the grounded magneto 506. Fuel may pass from the combustion chamber to an exhaust manifold or exhaust. If the exhaust manifold and/or the exhaust are hot, the fuel may ignite to cause a backfire.

Figure 1A:
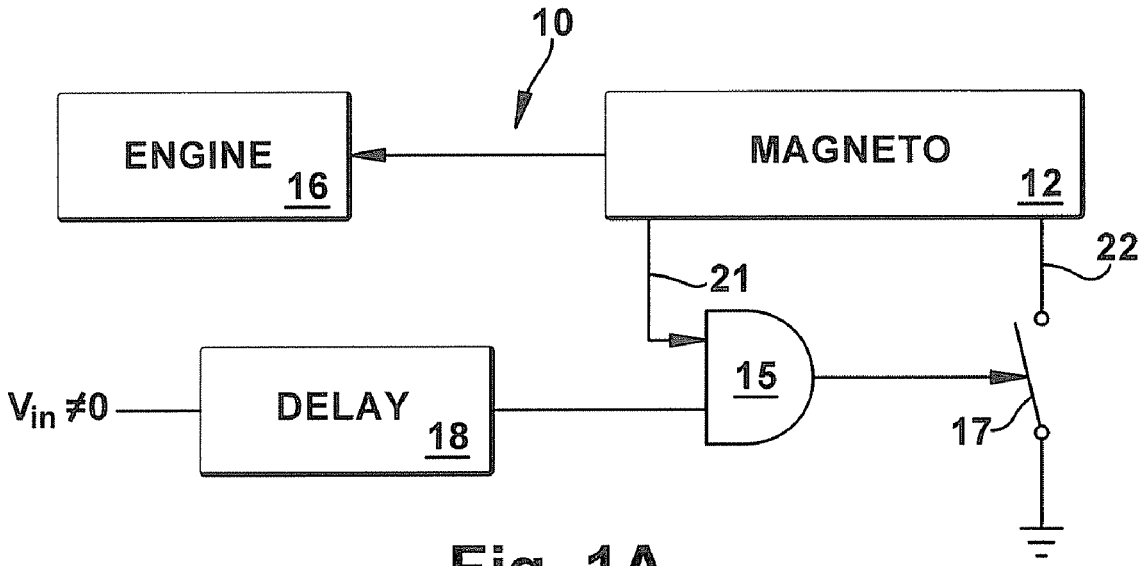
FIGS. 1A-1B are schematic functional block diagrams of a magneto control circuit constructed in accordance with the present invention.
Figure 1B:
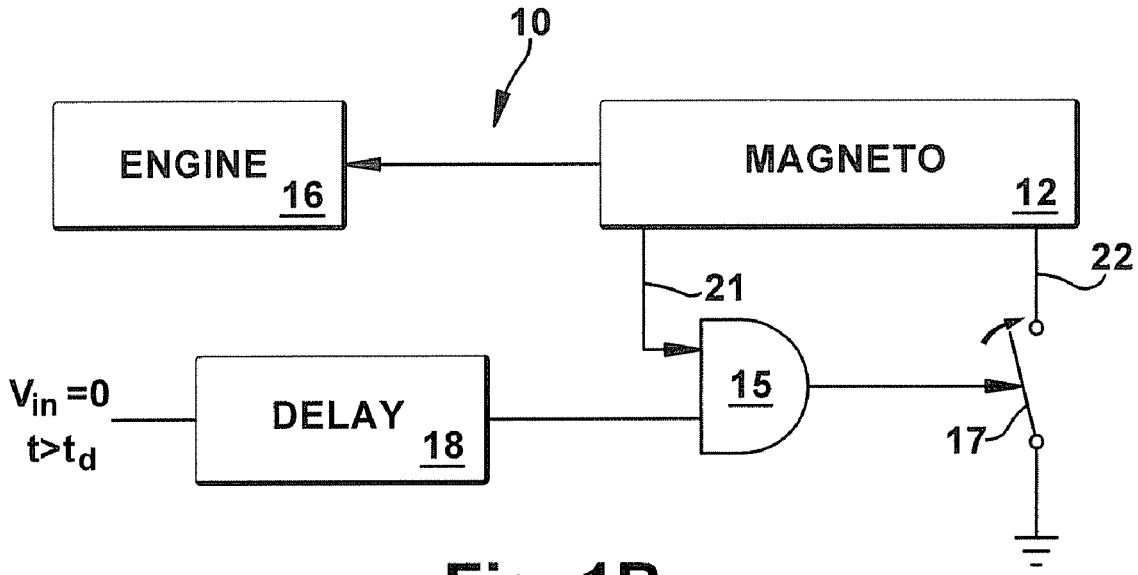

FIGS. 1A-1B schematically illustrate a magneto control circuit 10 that includes an engine 16, a magneto 12, a delay mechanism 18, and an electronic control device 17 that selectively connects and disconnects a direct path to ground for the magneto. When the electronic control device 17 is closed, the magneto 12 is grounded and no spark is provided to the engine 16. In FIG. 1A, the ignition switch (not shown) is closed and $V_{in}$ is being provided to the delay mechanism. The delay mechanism provides a control signal to a controller 15 that is shown schematically, and functions similar to, an OR logic gate. When $V_{in}$ is present, the delay mechanism provides a first control signal causes the controller 15 to keep the electronic control device in a disconnected position. After $V_{in}$ goes to zero when the ignition switch is turned off, the delay mechanism continues to send the first control signal for a delay period $t_d$. In FIG. 1B, after the delay period has passed, the delay mechanism sends a second control signal that, when combined with the output of the magneto, causes the controller to close the electronic control device 17 and ground the magneto.

Figure 2:
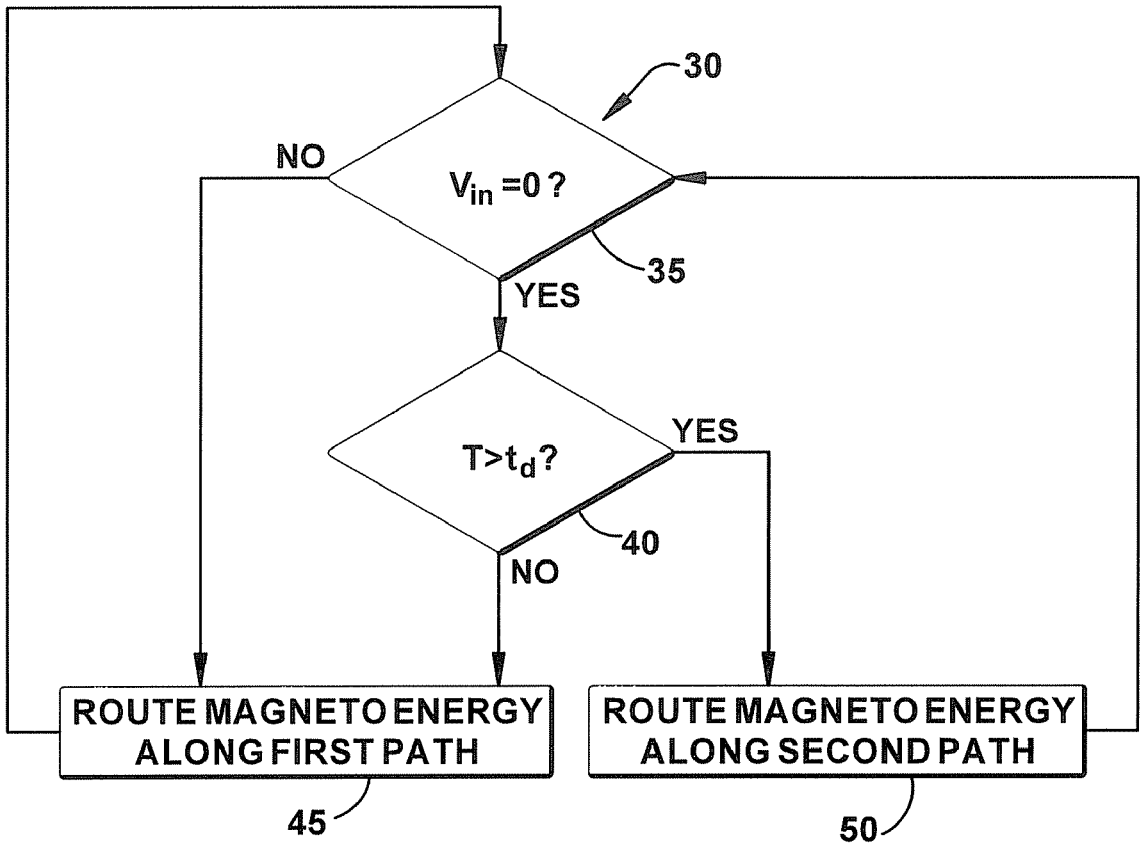
FIG. 2 is a flowchart outlining a method of controlling a magneto circuit according to an embodiment of the present invention.

FIG. 2 outlines a method 30 that controls a magneto having a control circuit that provides two alternate energy paths for the magneto's energy: a first path that allows the magneto to continue to spark and a second path that grounds the magneto. At 35, if $V_{in}$ is not zero, the ignition is turned on and the circuit routes the magneto's energy along the first path. If $V_{in}$ is zero but the delay period has not yet passed, at 40 the control circuit continues to route the magneto's energy along the first path. At 40 if the delay period has passed, the control circuit routes the magneto's energy along the second path at 50 to ground the magneto.

Figure 3A:
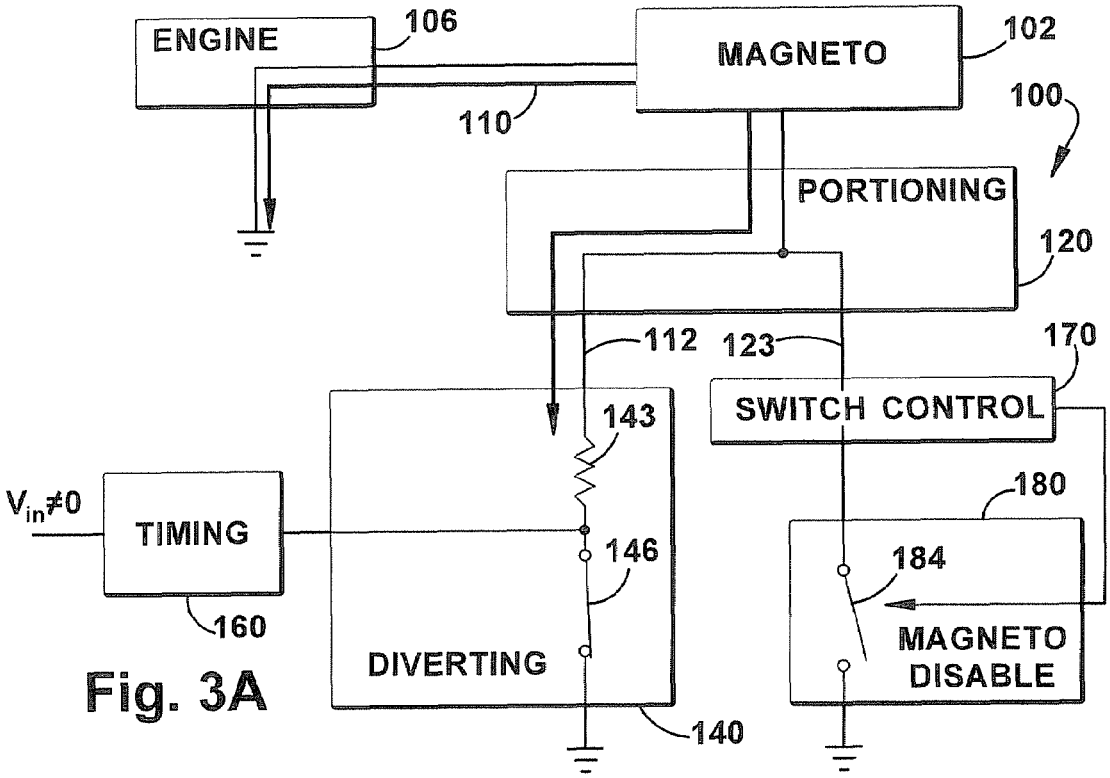
FIGS. 3A-3D are schematic functional block diagrams of a magneto control circuit constructed in accordance with the present invention.

FIGS. 3A-3D schematically illustrate an ignition circuit 100 that delays the grounding of magneto 102 for a period of time after the ignition is shut off to provide spark to combust fuel that may remain in the cylinders. The delay between the shutting off of the ignition and the grounding of the magneto is accomplished by using electrical power that is generated by the magneto so that an external power source is not necessary to accomplish the delay. $V_{in}$ is controlled by the ignition switch, having a user operable actuator such as a knob or key cylinder. When the ignition switch is on $V_{in}$ is supplied to the ignition circuit 100. In FIG. 3A, the engine 106 is running and the magneto 102 is providing spark to engine along a spark path 110. The magneto 102 is also electrically connected to a portioning arrangement 120. The portioning arrangement provides two alternate paths 112, 123 through which the magneto can discharge energy. A diverting arrangement that is part of the first alternate path 112, includes a diverter 146, shown schematically as a switch, that connects the magneto to ground through a load 143, shown schematically as a resistor. The amount of current that is drawn by the diverting arrangement is small enough to not significantly affect the spark capability of the magneto. The diverter 146 is controlled by a timing arrangement 160 and is maintained in the closed circuit condition by the timing arrangement when the ignition switch is on and for a time period subsequent to the ignition switch being turned off. When the ignition is on, the portioning arrangement does not correct the magneto to the second alternate path 123, which corresponds to a direct path to ground for the magneto. Hence, as long as the diverter 146 is closed, the portioning arrangement provides a single alternate path for the magneto through the load 143.

Figure 3B:
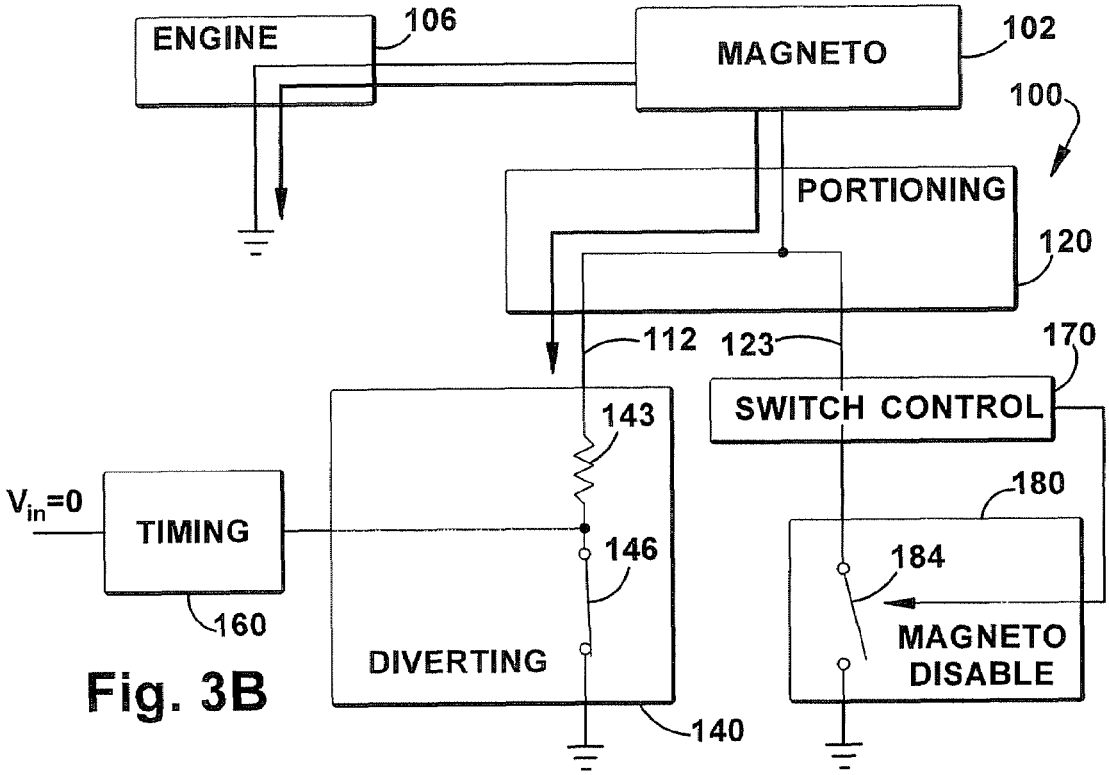
Figure 3C:
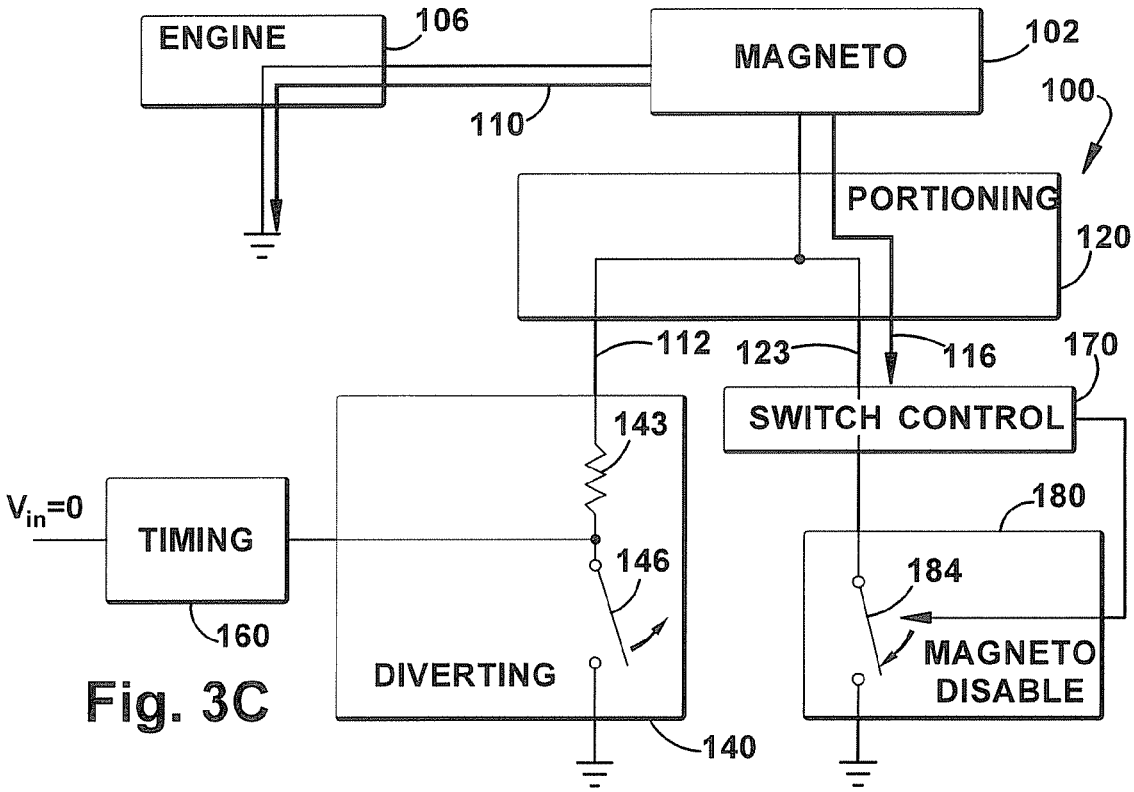
Figure 3D:
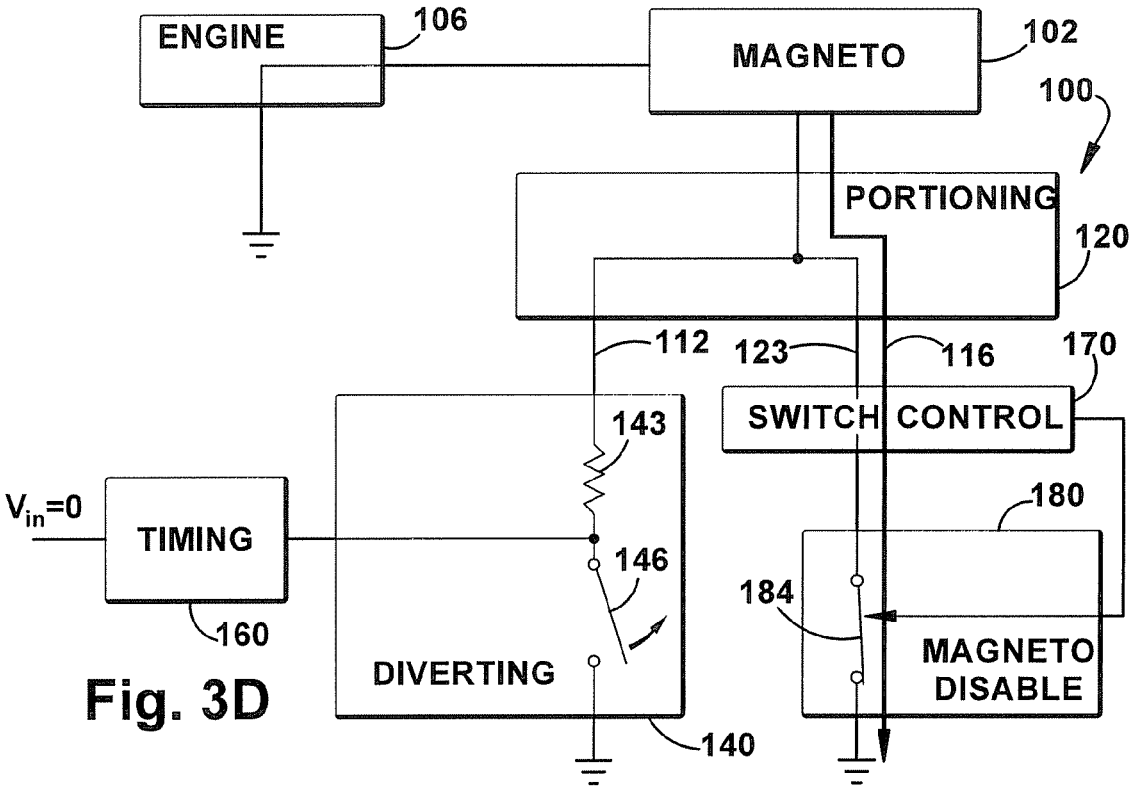

FIG. 3B illustrates the condition of the ignition circuit 100 just after the ignition switch is turned off to shut down the engine. $V_{in}$ goes to zero, however the timing arrangement 160 maintains the diverter 146 in the closed condition for a predetermined delay period. During this period, the magneto 102 continues to provide spark to the engine 106 along the spark path 110. FIG. 3C illustrates the condition of the ignition circuit 100 after the delay period expires. The timing arrangement 160 releases the diverter 146 so that the first alternate path 113 becomes an open circuit. In response to the disconnection of the first alternate path, the portioning arrangement routes energy from the magneto to the second alternate path 116 to a switch controller 170. The switch controller 170 uses the energy from the magneto to transition an electronic magneto disable switch 184 to a conducting condition, shown schematically as closing the magneto disable switch in FIGS. 3C and 3D. In FIG. 3D, the magneto disable switch is closed and a direct path to ground is provided for the magneto through the second alternate path 116. The magneto will not provide spark as long as the ignition circuit remains in the condition shown in FIG. 3D.

Figure 5:
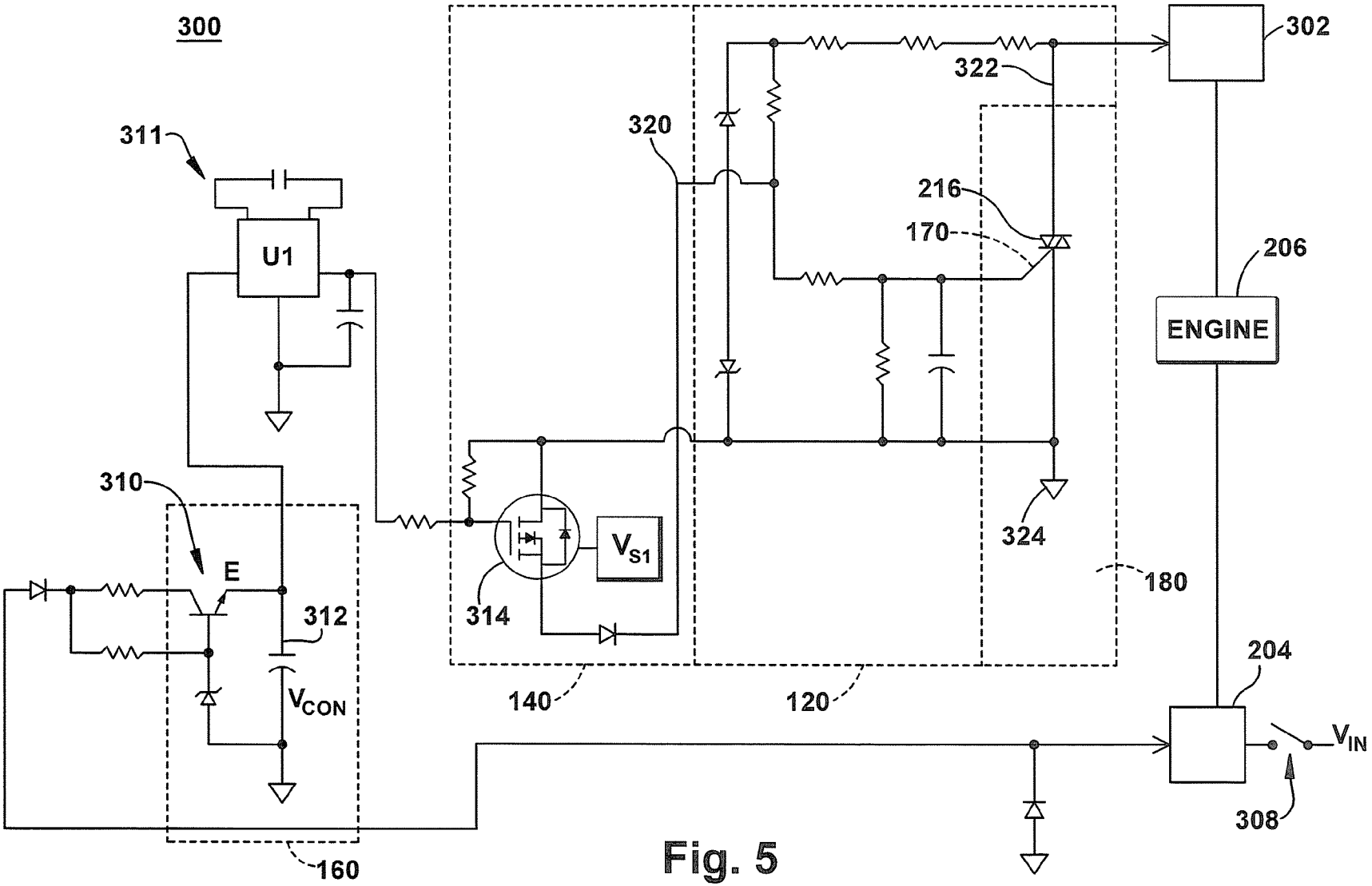
FIG. 5 is a schematic illustration of a magneto control circuit of a second embodiment.
Figure 6:
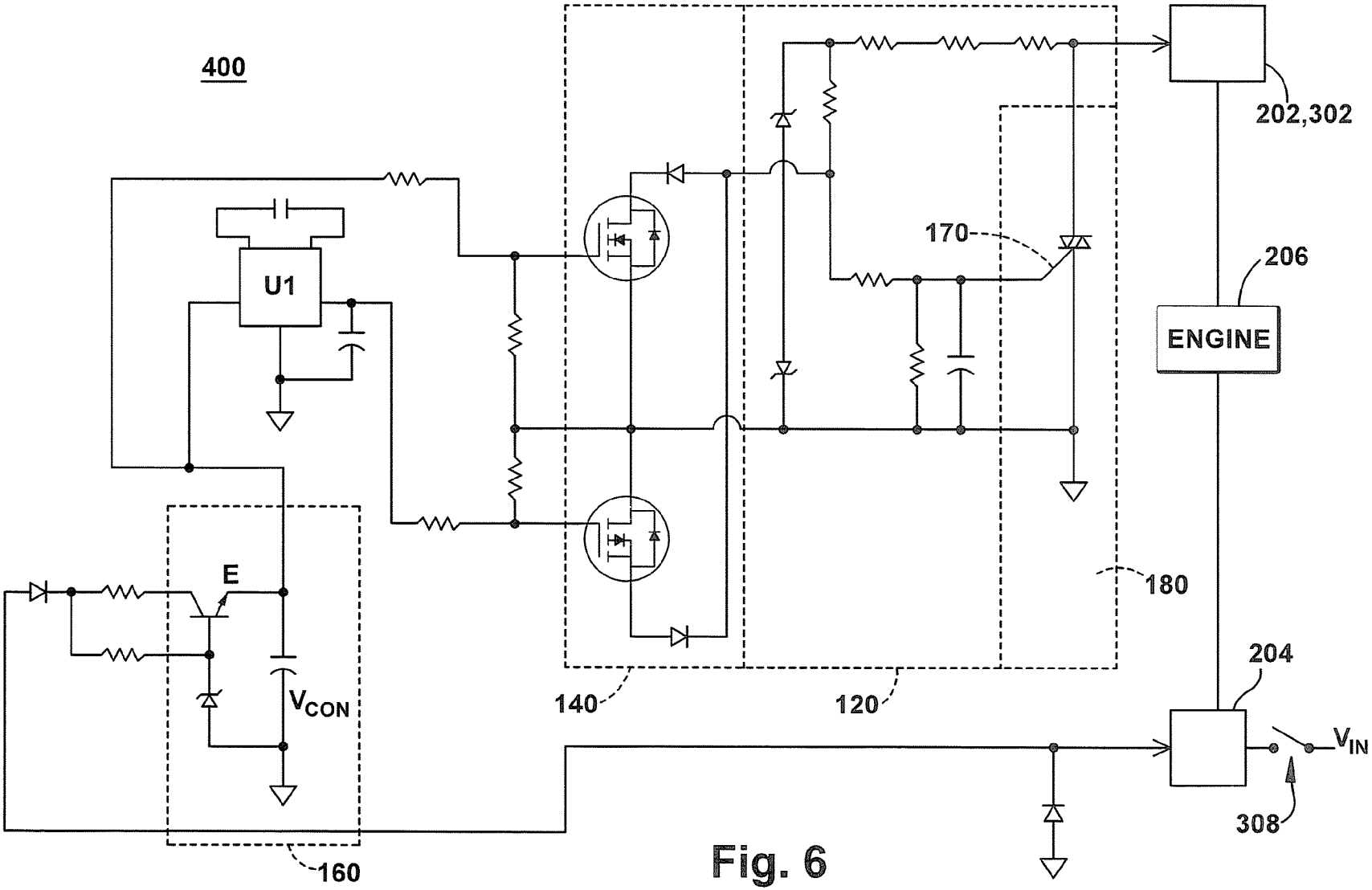
FIG. 6 is a schematic illustration of a magneto control circuit of a third embodiment.

As described with reference to FIGS. 3A-3D, the present invention relates to control circuits 200, 300, 400 that delay grounding of a magneto 202 for a period of time after power to a fuel pump or solenoid 204 is cut off, to allow fuel in the combustion chamber and/or fuel between the fuel pump 204 and the combustion chamber to be ignited in the combustion chamber and thereby prevent backfiring. As can be seen from the figures, the delay between removing power from the fuel pump 204 and grounding of the magneto 202 is accomplished by using electrical power that is generated by the magneto 202. A delay between removing power from the fuel pump 204 and grounding of the magneto 202 can be accomplished in a wide variety of different ways. FIGS. 2, 5 and 6 illustrate three examples of circuits that delay between removing power from the fuel pump 204 and grounding of the magneto 202. The present invention is not limited to the three illustrated circuits. Rather, the scope of the present invention encompasses any circuit that uses electrical power generated by a magneto to ground the magneto 202.

Figure 4:
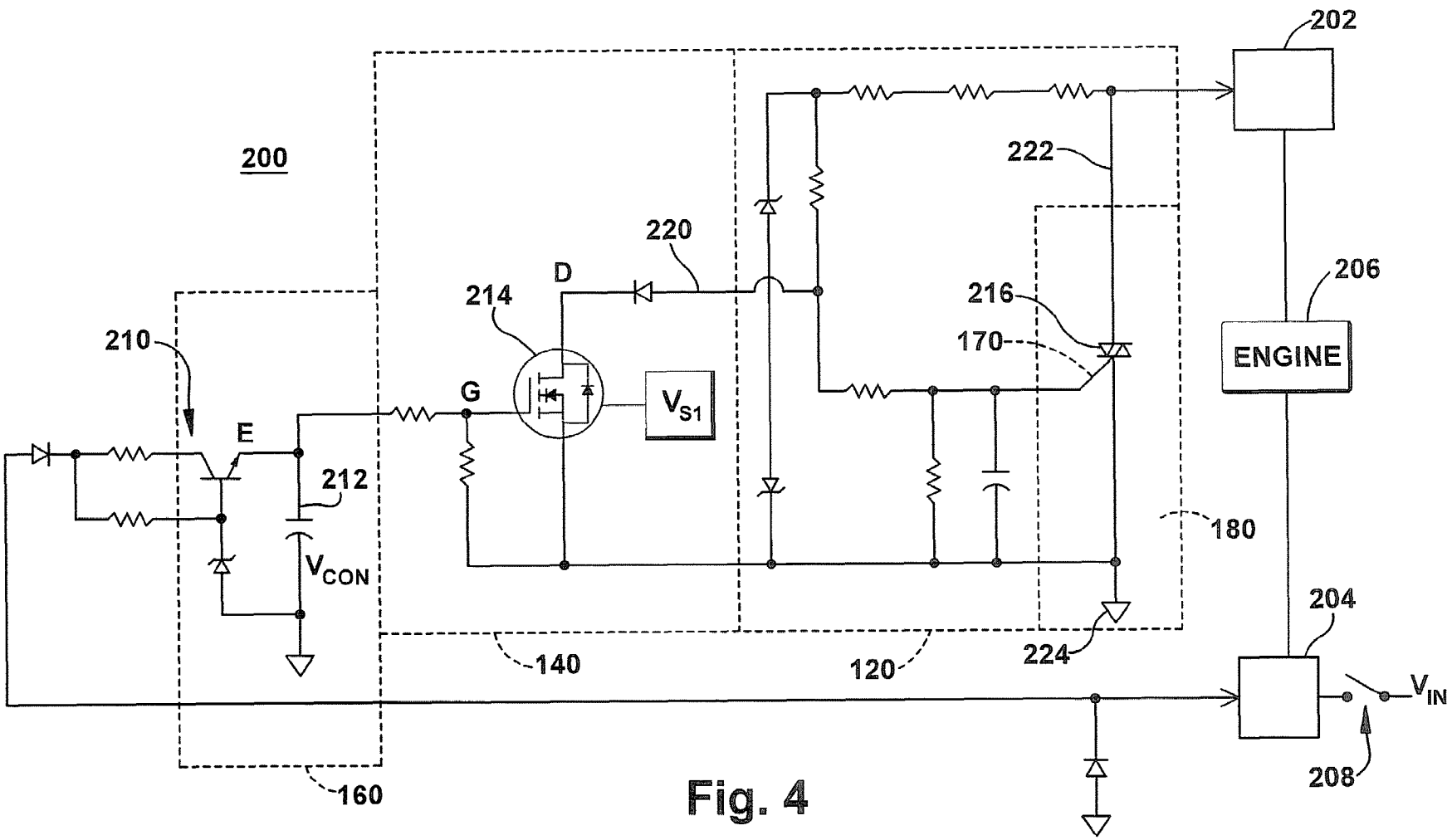
FIG. 4 is a schematic illustration of a magneto control circuit of a first embodiment.

FIG. 4 illustrates a first embodiment of a circuit 200 for controlling a magneto 202 and a fuel pump or solenoid 204 to thereby control an engine 206. The various functional modules of the circuit 200 that correspond roughly to those outlined in FIG. 3 are indicated by dashed outlines around a group of components. The circuit 200 includes an ignition switch 208, a voltage regulator 210, a timing capacitor 212, a first electronic control device 214, such as a FET or a MOSFET, and a second electronic control device 216, such as a TRIAC. It should be readily apparent that any voltage or current controlled electronic control device can be used as the first and second electronic control devices. When the ignition switch 208 is closed, input voltage $V_{IN}$ is applied to the fuel pump 204 to provide fuel to the engine. The input voltage $V_{IN}$ is also applied to the voltage regulator 210. The input voltage $V_{IN}$ may be any suitable voltage. In one embodiment, the input voltage $V_{IN}$ is supplied by a twelve volt battery that may provide the input voltage at between about nine and sixteen volts.

FIG. 4 illustrates one of the wide variety of different voltage regulation circuits that can be used as the voltage regulator. The voltage regulator provides a control voltage VCON to the timing arrangement 160, which in this embodiment corresponds to a timing capacitor 212 and related components, to charge the timing capacitor. The control voltage VCON is also provided to a first electronic control device 214, in this particular embodiment an n channel enhancement transistor, that forms part of the diverting arrangement 140. The control voltage VCON may be set to any predetermined voltage when the ignition switch is on. For example, the voltage regulator may set the control voltage VCON to 4.6 volts when the ignition switch is on. The voltage regulator 210 can be omitted if the input voltage $V_{IN}$ is provided at stable value.

The first electronic control device 214 is on or closed when the control voltage VCON is above a first switch voltage setpoint VS1. The diverting arrangement 140 thus provides a first alternate path 220 for the magneto through several resistors to ground. The first switch voltage setpoint VS1 may be any voltage that is below the control voltage VCON when the ignition switch 208 is on. For example, the first switch voltage setpoint VS1 may be 2 volts when the control voltage VCON is 4.6 volts when the ignition switch 208 is on. When the first electronic control device 214 is on, the node 220 is grounded. As a result, the second electronic control device 216 stays off, and the portioning arrangement 120 leaves the second alternate path 222 from the magneto 202 to ground 220 open. When the magneto 202 is not grounded, the magneto operates to provide spark to the engine.

When the ignition switch 208 is turned off or opened, input voltage $V_{IN}$ is no longer applied to the fuel pump 204. The fuel pump stops operating and additional fuel does not flow to the engine. The input voltage VIN is also removed from the voltage regulator 210. The timing capacitor 212 discharges to continue to provide the control voltage VCON to the first electronic control device 214. In this manner, the timing arrangement 160 maintains the first electronic control device in the closed position. The first electronic control device 214 remains on until the control voltage VCON drops below the first switch voltage setpoint VS1. As a result, the magneto 202 continues to provide spark for a period of time, until the timing capacitor 212 discharges to a point where the control voltage VCON drops below the first switch voltage setpoint VS1. For example, the timing capacitor 212 that is sized to discharge at a rate that provides the desired delay. For example, the delay may be such that VCON remains above the switch voltage setpoint VS1 and the magneto continues to provide spark for a time between about 0.5 seconds and 1.0 seconds, such as, about 0.75 seconds. When the control voltage VCON drops below the first switch voltage setpoint VS1, the first electronic control device 214 turns off and the node 220 is no longer grounded. As a result, voltage generated by the magneto 202 is applied by the portioning arrangement 120 to the second electronic control device 216. In the described embodiment, the switch controller 170 of FIG. 1 corresponds roughly to the gate on the TRIAC that functions as the second electronic control device 216. The second electronic control device functionally corresponds to the magneto disable module 180 in FIG. 1. When the second electronic control device 216 is on, the path 222 from the magneto 202 to ground 224 is closed. The second electronic control device 216 closes each time a voltage pulse is generated by the magneto. When the magneto 202 is grounded spark is not provided to the engine and the engine stops running. The circuit illustrated by FIG. 4 is configured to control an engine with a magneto 202 that generates positive voltage pulses.

FIG. 5 illustrates an embodiment of a circuit 300 for controlling a negative magneto 302 and a fuel pump or solenoid 204 to thereby control an engine 206. As with FIG. 4, the various functional modules of the circuit 300 that correspond roughly to those outlined in FIG. 3 are indicated by dashed outlines around a group of components. The circuit 300 includes an ignition switch 308, a voltage regulator 310, an inverter 311, a timing capacitor 312, a first electronic control device 314, such as a FET or a MOSFET, and a second electronic control device 316, such as a TRIAC. It should be readily apparent that any voltage or current controlled electronic control device can be used as the first and second electronic control devices. When the ignition switch 308 is closed, input voltage $V_{IN}$ is applied to the fuel pump 304 to provide fuel to the engine. The input voltage $V_{IN}$ is also applied to the voltage regulator 310. The inverter 311 is between the timing arrangement 120' and the diverting arrangement 140'.

The voltage regulator provides a control voltage VCON to the timing capacitor 312 to charge the timing capacitor. The control voltage VCON is also provided to the inverter 311. The inverter 311 converts the control voltage VCON to a negative control voltage −VCON In one embodiment, the negative control voltage has the same magnitude as the control voltage VCON. In other embodiments, the inverter changes the magnitude of the control voltage or regulates and changes the polarity of the input voltage, eliminating the need for a separate voltage regulator.

The negative control voltage −VCON is provided to diverting arrangement 140 at the first electronic control device 314. The first electronic control device 314 is on when the negative control voltage −VCON is below a first switch negative voltage setpoint −VS1. The first switch negative voltage setpoint −VS1 may be any voltage that is above the negative control voltage −VCON when the ignition switch 308 is on and the input voltage is provided to the circuit. For example, the first switch negative voltage setpoint −VS1 may be −2 volts when the negative control voltage −VCON is −4.6 volts when the ignition switch 308 is on. When the first electronic control device 314 is on, the node 320 is grounded. As a result the second electronic control device 316 stays off, leaving the path 320 from ground 320 to the magneto 302 open. When the magneto 302 is not grounded, the magneto operates to provide spark to the engine.

When the ignition switch 308 is turned off or opened, input voltage VIN is no longer applied to the fuel pump 304. The fuel pump stops operating and additional fuel does not flow to the engine. The input voltage VIN is also removed from the voltage regulator 310. The timing capacitor 312 discharges to continue to provide the control voltage VCON to the inverter 311, which continues to provide the negative control voltage −VCON to the first electronic control device 314. The first electronic control device 314 remains on until the negative control voltage −VCON rises above the first switch negative voltage setpoint −VS1. As a result, the magneto 302 continues to operate for a period of time, until the timing capacitor 312 discharges to a point where the negative control voltage −VCON rises above (approaching zero volts) the first switch negative voltage setpoint −VS1. When the negative control voltage −VCON rises above the first switch negative voltage setpoint −VS1, the first electronic control device 314 turns off and the node 320 is no longer grounded. As a result, the portioning arrangement 120' causes voltage generated by the magneto 302 to be applied through the switch controller 170 to the second electronic control device 316 to turn the second electronic control device on. When the second electronic control device 316 is on, the path 322 from ground 324 to the magneto 302 is closed. The second electronic control device 316 closes each time a voltage pulse is generated by the magneto. When the magneto 302 is grounded spark is not provided to the engine and the engine stops running. The circuit illustrated by FIG. 5 is configured to control an engine with a magneto 302 that generates negative voltage pulses.

FIG. 6 illustrates a circuit 400 that works with both magnetos that generate positive pulses and magnetos that generate negative pulses. As with FIG. 4, the various functional modules of the circuit 400 that correspond roughly to those outlined in FIG. 3 are indicated by dashed outlines around a group of components. The circuit 400 combines the circuits 200 and 300 illustrated by FIGS. 4 and 5 and is therefore not described in detail. When the circuit 400 is connected to a magneto that generates positive pulses, the circuit 400 selectively grounds the magneto in the same manner as the circuit 200. When the circuit 400 is connected to a magneto that generates negative pulses, the circuit 400 selectively grounds the magneto in the same manner as the circuit 300.

It should be understood that the embodiments discussed above are representative of aspects of the invention and are provided as examples and not an exhaustive description of implementations of an aspect of the invention.

While various aspects of the invention are described and illustrated herein as embodied in combination in the exemplary embodiments, these various aspects may be realized in many alternative embodiments, either individually or in various combinations and sub-combinations thereof. Unless expressly excluded herein all such combinations and sub-combinations are intended to be within the scope of the present invention. Still further, while various alternative embodiments as to the various aspects and features of the invention, such as alternative materials, structures, configurations, methods, devices, software, hardware, control logic and so on may be described herein, such descriptions are not intended to be a complete or exhaustive list of available alternative embodiments, whether presently known or later developed. Those skilled in the art may readily adopt one or more of the aspects, concepts or features of the invention into additional embodiments within the scope of the present invention even if such embodiments are not expressly disclosed herein. Additionally, even though some features, concepts or aspects of the invention may be described herein as being a preferred arrangement or method, such description is not intended to suggest that such feature is required or necessary unless expressly so stated. Still further, exemplary or representative values and ranges may be included to assist in understanding the present invention however, such values and ranges are not to be construed in a limiting sense and are intended to be critical values or ranges only if so expressly stated.

The invention claimed is:

1. An engine control circuit comprising:

an electrical control device electrically coupled to a magneto such that said electronic control device controls the magneto to shut an engine down when the electronic control device is in a first state and controls the magneto to allow the engine to run when the electronic control device is in a second state;

a portioning arrangement coupled to the electronic control device such that the portioning arrangement provides a portion of energy generated by said magneto to said electronic control device to place said electronic control device in said first state and shut down said engine;

a diverting arrangement coupled to the portioning arrangement such that the diverting arrangement selectively diverts said portion of energy away from said electronic control device to place the electronic control device in said second state to allow the engine to run;

a timing arrangement coupled to the diverting arrangement such that the diverting arrangement diverts said portion of energy away from said electronic control device to maintain the electronic control device in said second state and allow the engine to run for a predetermined period of time after an engine shutdown signal is provided and such that the portion of energy is provided to the electronic control device after said predetermined period of time to allow said electronic control device to change to said first state to shut the engine down.

2. The engine control circuit of claim 1 wherein the shutdown signal comprises removing power from at least one component of the timing arrangement.

3. The engine control circuit of claim 1 wherein the diverting arrangement comprises a second electronic control device.

4. The engine control circuit of claim 1 wherein the timing arrangement comprises a capacitor.

5. The engine control circuit of claim 1 wherein the diverting arrangement is a second electronic control device that is closed to divert said portion of energy away from the electronic control device coupled to the magneto when a magnitude of voltage applied to the second electronic control device is above a predetermined set point and that is opened to allow said portion of energy to be provided to said electronic control device coupled to the magneto.

6. The engine control circuit of claim 1 wherein the diverting arrangement is a second electronic control device that is closed to divert said portion of energy away from the electronic control device coupled to the magneto when a magnitude of voltage applied to the second electronic control device is above a predetermined set point and that is opened to allow said portion of energy to be provided to said electronic control device coupled to the magneto, and wherein the timing arrangement comprises a capacitor that is charged to a voltage magnitude above the predetermined set point when power is applied to the timing arrangement and provides voltage at magnitudes above the predetermined set point to the second electronic control device for said predetermined period of time after power is removed from the timing arrangement.

7. The engine control circuit of claim 1 further comprising an inverting arrangement coupled to the timing arrangement that inverts a signal from the timing arrangement to enable the engine control circuit to control a magneto that outputs negative polarity pulses.

8. The engine control circuit of claim 1 wherein the diverting arrangement comprises a first electronic control device arranged to be controlled by application of a positive voltage signal and a second electronic control device arranged to be controlled by application of a negative voltage signal.

9. The engine control circuit of claim 8 further comprising an inverting device coupled to the timing arrangement and the diverting arrangement such that the timing arrangement provides both a positive voltage signal to the first electronic control device and a negative voltage signal to the second electronic control device to allow the engine control circuit to operate with a magneto that outputs positive voltage pulses and with magnetos that output negative voltage pulses.

10. An engine control circuit comprising:

an electronic control device electrically coupled to a magneto such that said electronic control device grounds the magneto to shut an engine down when the electronic control device is in a first state and opens an electrical path between the magneto and ground to allow the engine to run when the electronic control device is in a second state;

a portioning arrangement coupled to the electronic control device such that the portioning arrangement provides a portion of energy generated by said magneto to said electronic control device to place said electronic control device in said first state and ground said magneto;

a diverting arrangement coupled to the portioning arrangement such that the diverting arrangement selectively diverts said portion of energy away from said electronic control device to place the electronic control device in said second state to allow the engine to run;

a timing arrangement coupled to the diverting arrangement such that the diverting arrangement diverts said portion of energy away from said electronic control device to maintain the electronic control device in said second state and allow the engine to run for a predetermined period of time after power is removed from said timing circuit and such that the portion of energy is provided to the electronic control device after said predetermined period of time to allow said electronic control device to change to said first state to ground the magneto and shut the engine down.

11. The engine control circuit of claim 10 wherein the diverting arrangement comprises a second electronic control device.

12. The engine control circuit of claim 10 wherein the timing arrangement comprises a capacitor.

13. The engine control circuit of claim 10 wherein the diverting arrangement is a second electronic control device that is closed to divert said portion of energy away from the electronic control device coupled to the magneto when a magnitude of voltage applied to the second electronic control device is above a predetermined set point and that is opened to allow said portion of energy to be provided to said electronic control device coupled to the magneto.

14. The engine control circuit of claim 10 wherein the diverting arrangement is a second electronic control device that is closed to divert said portion of energy away from the electronic control device coupled to the magneto when a magnitude of voltage applied to the second electronic control device is above a predetermined set point and that is opened to allow said portion of energy to be provided to said electronic control device coupled to the magneto, and wherein the timing arrangement comprises a capacitor that is charged to a voltage magnitude above the predetermined set point when power is applied to the timing arrangement and provides voltage at magnitudes above the predetermined set point to the second electronic control device for said predetermined period of time after power is removed from the timing arrangement.

15. The engine control circuit of claim 10 further comprising an inverting arrangement coupled to the timing arrangement that inverts a signal from the timing arrangement to enable the engine control circuit to control a magneto that outputs negative polarity pulses.

16. The engine control circuit of claim 10 wherein the diverting arrangement comprises a first electronic control device arranged to be controlled by application of a positive voltage signal and a second electronic control device arranged to be controlled by application of a negative voltage signal.

17. The engine control circuit of claim 16 further comprising an inverting device coupled to the timing arrangement and the diverting arrangement such that the timing arrangement provides both a positive voltage signal to the first electronic control device and a negative voltage signal to the second electronic control device to allow the engine control circuit to operate with a magneto that outputs positive voltage pulses and with magnetos that output negative voltage pulses.

18. An engine control circuit comprising:

a magneto;

a switch having an actuator that is movable between a an engine run position and an engine kill position;

a portioning arrangement electrically coupled to the magneto such that portioning arrangement outputs a portion of energy generated by the magneto;

an electronic control device in electrical communication with the portioning arrangement and the magneto such that the electronic control device is switched between a first state where the electronic control device grounds the magneto to kill the engine and a second state where the electronic control device opens a path between the magneto and ground to allow the engine to run by selective application of said portion of energy to said electronic control device;

wherein the electronic control device is maintained in the second state for a predetermined period of time after the after the actuator is moved to the kill position and the electronic control device is switched to the first state to ground the magneto and kill the engine when said predetermined period of time has elapsed.

19. A method of controlling an engine comprising:

providing a portion of energy generated by the magneto for control of the engine; applying an engine shutdown signal;

diverting said portion of energy away from an electronic control device to allow the engine to run for a predetermined period of time after the engine shutdown signal is applied; and providing said portion of energy to said electronic control device after said predetermined period of time has elapsed such that said portion of energy causes the electronic control device to switch to a state that causes the engine to shut down.

20. The method of claim 19 wherein said state that causes the engine to shut down comprises a closed state that grounds a magneto.

21. The method of claim 19 wherein the shutdown signal comprises removing power.

22. A method of controlling an engine comprising:

moving a switch actuator from an engine run position to an engine kill position;

maintaining an electronic control device in an open state where the electronic control device opens a path between a magneto and ground to allow the engine to run for a predetermined period of time after the after the actuator is moved to the kill position;

applying a portion of energy generated by the magneto to said electronic control device to switch said electronic control device to a closed state that grounds the magneto to kill the engine once the predetermined period of time has elapsed.

23. A method of controlling an engine comprising:

providing a portion of energy generated by a magneto for control of the engine; applying an engine shutdown signal;

diverting said portion of energy along a first path that allows the engine to run for a predetermined period of time after the engine shutdown signal applied; and providing said portion of energy along a second path after said predetermined period of time has elapsed, wherein providing said portion of energy along the second path causes the engine to shut down.

* * * * *